US005558252A

United States Patent [19]

Stapensea et al.

[11] Patent Number: 5,558,252

[45] Date of Patent: Sep. 24, 1996

[54] PORTABLE CHEMCIAL TANK WITH INTEGRAL TRANSFER SYSTEM

[75] Inventors: Neil P. Stapensea, Raleigh; Kevin K. Gaskins, Apex; Dan J. Proska, Chapel Hill, all of N.C.; Gil Rollison, Memphis, Tenn.

[73] Assignee: BASF Corporation, Mt. Olive, N.J.

[21] Appl. No.: 412,337

[22] Filed: Mar. 31, 1995

[51] Int. Cl.[6] ..... B67D 5/06

[52] U.S. Cl. ..... 222/181.2; 222/183; 222/184; 222/401; 222/444; 222/464.7

[58] Field of Search ..... 222/131, 152, 222/157, 158, 180, 181.2, 183, 184, 401, 444, 451, 464.7; 141/231

[56] References Cited

U.S. PATENT DOCUMENTS

| | | | |
|---|---|---|---|
| 2,985,359 | 5/1961 | Hanje | 222/401 X |
| 4,958,747 | 9/1990 | Sheets | 222/183 X |
| 5,129,552 | 7/1992 | Painchaud et al. | 222/183 X |
| 5,199,472 | 4/1993 | Rollinson | 222/152 X |
| 5,340,218 | 8/1994 | Cuthbertson | 222/181.3 X |
| 5,366,119 | 11/1994 | Kline | 222/180 |

*Primary Examiner*—Joseph A. Kaufman
*Attorney, Agent, or Firm*—Nixon & Vanderhye P.C.

[57] ABSTRACT

A self-contained, portable liquid chemical supply tank storage and transfer unit includes an external support shell having upper and lower support shell sections concentrically joined to one another. The upper support shell section includes diametrically opposed upright arms which define therebetween a generally U-shaped space in which the transfer system is positioned. The lower support shell section houses a liquid chemical storage tank. The transfer system includes a metering canister fluid-connected to the liquid chemical within the storage tank, a selector valve assembly and a pump (preferably a manually-actuated hand pump). Operation of the pump will allow liquid chemical to be drawn from the storage tank and into the canister. The liquid chemical in the metering canister may then be transferred (e.g., via gravity or another pump) to another tank, for example, a mixing tank associated with an agricultural spray implement.

17 Claims, 1 Drawing Sheet

PORTABLE CHEMCIAL TANK WITH INTEGRAL TRANSFER SYSTEM

RELATED APPLICATIONS

This application is related to U.S. Design Patent Application Ser. No. 29/038,774 (Atty. Dkt. No. 937-696) entitled "Design For: Portable Tank", filed currently herewith in the name of the same inventors as the present application, the entire content of which is expressly incorporated hereinto by reference.

FIELD OF INVENTION

The present invention generally relates to portable chemical tanks. In preferred embodiments, the present invention relates to a portable chemical tank having an integral closed transfer system so that aliquot volumetric portions of the chemical in the tank can be transferred therefrom (e.g., to a mixing tank) without exposing the user to the chemical.

BACKGROUND AND SUMMARY OF THE INVENTION

It is oftentimes desirable for liquid chemicals to be transferred from a supply tank in precise volumetric quantities. For example, liquid agricultural chemicals (e.g., pesticides, herbicides, fertilizers and the like) are oftentimes mixed with water in precise amounts by growers for application to crops. Because of the desire to minimize (if not eliminate entirely) exposure to the agricultural chemicals during the transfer procedure, it is typically not satisfactory for the agricultural chemicals to simply be poured into the mixing tank. Instead, the growers must use a "dosed" transfer system (i.e., a system which is not open to ambient environment but allows transfer of the agricultural chemical directly from the supply tank to the mixing tank).

Recently, a portable, self-contained closed chemical transfer system has been proposed in U.S. Pat. No. 5,199,472 issued on Apr. 6, 1993 to Gfi Rollison (the entire content of which is expressly incorporated hereinto by reference). According to the Rollison '472 patent, a closed chemical transfer system is provided which includes a metering canister and the means for applying a vacuum to the canister so as to allow liquid chemical to be transferred from a separate supply tank and into the canister. By releasing the vacuum in the canister and closing the liquid chemical supply line thereto, the liquid chemical in the canister may then be transferred to another tank.

While the transfer system disclosed in the Rollison '472 patent represents a satisfactory solution for the "dosed" transfer of liquid chemicals, some improvements are still desirable. For example, it would especially be desirable if the liquid chemical transfer system disclosed in the Rollison '472 patent was provided with a liquid chemical tank supply assembly so that the entire tank assembly and transfer system could be transported as an integral unit to agricultural fields. It is towards providing such an improvement that the present invention is directed.

In general, the present invention is embodied in a self-contained, portable liquid chemical supply tank storage and transfer unit. The unit is generally comprised of an external support shell having upper and lower support shell sections joined to one another. The upper support shell section includes diametrically opposed upright arms which define therebetween a generally U-shaped space in which the transfer system is positioned. The lower support shell section houses a liquid chemical storage tank.

The transfer system includes a metering canister fluid-connected to the liquid chemical within the storage tank, a selector valve assembly and a pump (preferably a manually-actuated hand pump). Operation of the pump will be evacuate the canister to thereby allow liquid chemical to be drawn from the storage tank and into the canister. The liquid chemical in the metering canister may then be transferred (e.g., via gravity or another pump) to another tank, for example, a mixing tank associated with an agricultural spray implement. In such a manner, therefore, transference of the liquid chemical to another tank is accomplished without exposing the user to the liquid chemical thereby transferred, while also permitting the liquid chemical to be transported easily to its intended use site.

Further aspects and advantages of this invention will become more clear after careful consideration is given to the detailed description of the preferred exemplary embodiments thereof which follow.

BRIEF DESCRIPTION OF THE DRAWINGS

Reference will hereinafter be made to the accompanying FIG. 1 which depicts a presently preferred embodiment of the liquid chemical storage and transfer tank unit according to the present invention in a partially sectioned elevational perspective.

DETAILED DESCRIPTION OF THE PREFERRED EXEMPLARY EMBODIMENT

Figure 1:
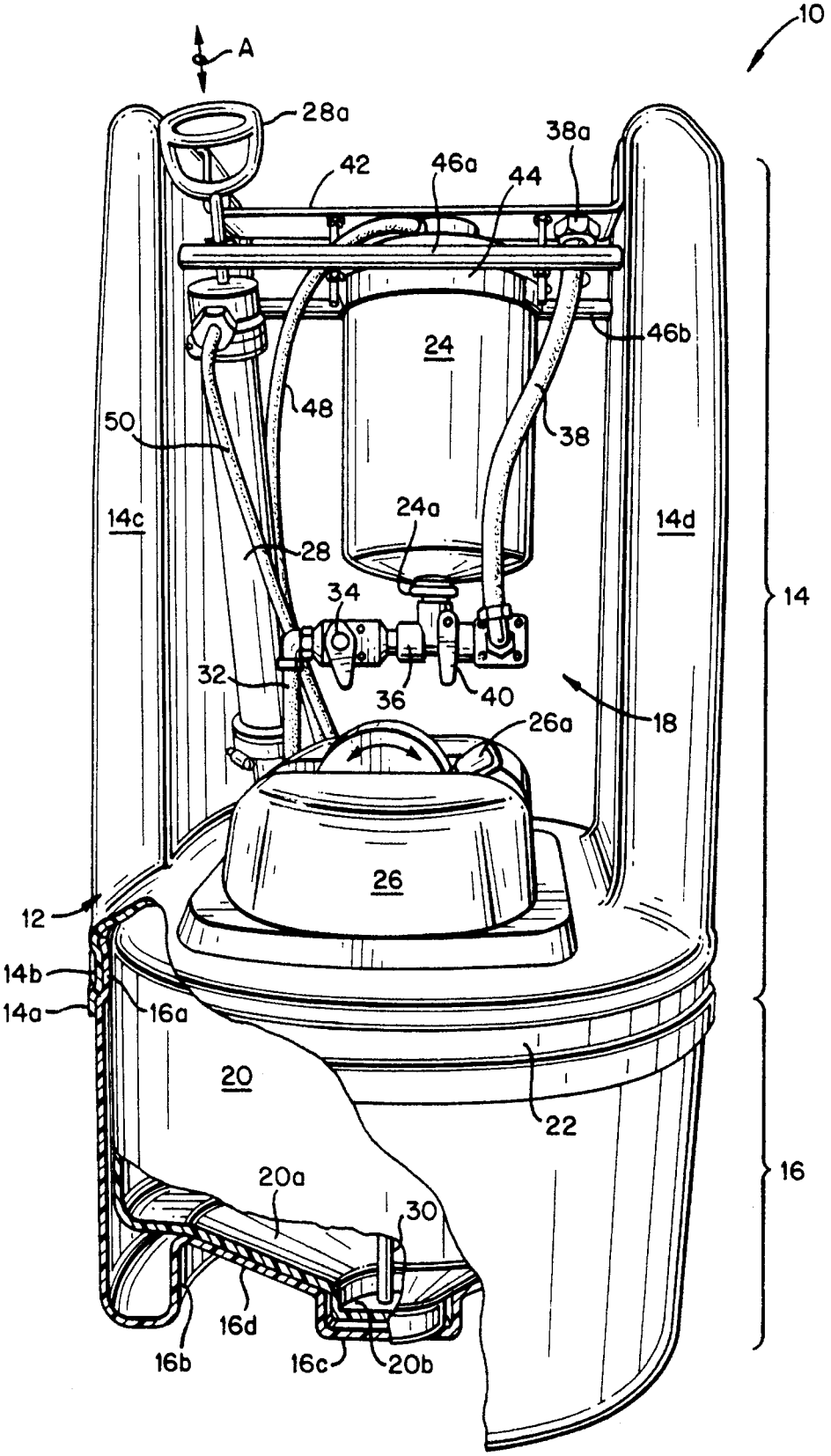

Accompanying FIG. 1 depicts a presently preferred embodiment of the liquid chemical storage and transfer tank unit 10 according to the present invention. The unit 10 is generally comprised of an external support shell 12 comprised of separate, but concentrically joined, upper and lower support shell sections 14, 16, respectively, and a transfer system 18. The lower support shell section 16 encloses a liquid chemical storage tank 16 of desired volumetric capacity (e.g., 15 gallons).

The lower rim **14*a* of the upper support shell section 14 is sleeved over the upper rim 16*a* of the lower support shell section 16 so that the sections 14, 16 are joined as a unit. The sections 14, 16 are maintained as a unit by means of a connecting strap 22 which is positioned in the slight recess 14*b* formed in the lower rim 14*a* of the upper shell section 14. Thus, by removing the strap 22, the upper and lower support shell sections 14, 16 may be separated from one another so as to allow access to the storage tank 20** for purposes of refilling or replacement.

The upper support shell 14 includes a diametrically opposed pair of upstanding hollow support arms **14*c*, 14*d*, respectively, which define therebetween a generally U-shaped interior space in which the transfer system 18 is positioned. In this regard, the support arms 14*c*, 14*d* are preferably unitarily formed (i.e., are one-piece structures) with the upper support shell 14, for example, by molding the support shell 14 and its associated upright hollow support arms 14*c*, 14*d*** from a suitable plastics material (e.g., polyethylene).

The lower support shell 16 is provided with an annular hollow foot **16*b* about its lower perimeter and a central sump support 16*c* joined to the foot 16*b* via a frustro-conically shaped bottom wall 16*d*. The bottom wall 20*a* of the storage tank 20 is thus conformably shaped to the bottom wall 16*d*** of the lower support shell 16 and is provided with a sump cup 20*b* which is nested within the sump support 16*c*.

The transfer system 18 is in accordance with the disclosure of the above-cited Rollison '472 patent. In this regard, the transfer system 18 employed according the present invention will most preferably include metering canister 24, a selector valve assembly 26, and a manually-actuated hand pump 28. An intake conduit 30 having its terminal end positioned within the sump cup 20*b* is fluid-connected to the canister inlet/discharge opening 24*a* through the selector valve 26, inlet conduit 32, control valve 34 and T-connector 36. On the other hand, the discharge coupling 38*a* at the terminal end of the discharge hose 38 is fluid-connected to the canister inlet/discharge opening 24*a* via T-connector 36 and the discharge valve 40.

A bridge support member 42 spans the opposed upright arms 14*c*, 14*d* of the upper support shell 14 so that the canister 24 may be dependently supported therefrom via bracket member 44. A pair of parallel handle bars 46*a*, 46*b* likewise span the opposed upright arms 14*c*, 14*d* of the upper support shell 14 to allow for carrying and/or manual handling of the unit 10.

The hand pump 28 is fluid-connected at its lower end to the upper end of canister 24 through the selector switch 26 via evacuation hose 48, while the upper end of the hand pump 28 is fluid-connected to the tank 20 by a suitable fitting not shown. Thus, any chemical vapors which may be present in the air within the canister 24 when evacuated by the hand pump 28 via line 48 are returned to the tank 20 via line 50.

In operation, a user will initially move the selector switch handle 26*a* of the selector switch assembly 26 to the "fill" position as shown in FIG. 1 and open the valve 34. Manual reciprocation of the handle 28*a* associated with the hand pump 28 (arrow $A_1$) will thus create a vacuum within the canister 24 to draw liquid chemical through the intake conduit 30 and the line 32. Continued reciprocation of the handle 28*a* of the hand pump 28 will thus continue to fill the canister 24 until a desired volume of chemical has been transferred from the tank 20 thereto. To assist in determining the volumetric level of liquid chemical in the canister 24, a transparent window having a volumetrically graduated scale may be provided with the canister 24, or the canister 24 may be transparent or sufficiently translucent to allow the liquid chemical to be visibly perceptible therein in relation to a volumetrically graduated scale.

If a volume of the liquid chemical in excess of that desired is transferred into the canister 24, the switch handle 26i amay be moved into its "empty" position opposite to that shown in FIG. 1 so as to release the vacuum in the canister 24 and thereby allow the liquid to flow back into the tank 20 via hose 32 and intake conduit 30. When the level of the liquid chemical within the canister 24 has been depleted as desired, the valve 34 may be closed to prevent further return of the liquid chemical into tank 20.

Once the desired volume of liquid chemical has been transferred to the canister 24, the discharge coupling 38*a* of the discharge hose 38 may be coupled to another tank or vessel (e.g., a mix tank associated with an agricultural spray implement). At this time, the valve 34 is closed and the valve 40 may be opened. The vacuum in the canister 24 is thereby released to allow the liquid in the canister to flow through the discharge hose 38, for example, under gravity or via a pump (not shown). In order to allow for gravity discharge of the liquid chemical from the canister 24, the discharge coupling 38*a* will be moved to a point lower than the canister 24 by virtue of the flexible hose 38.

The various component parts of the unit 10 according to this invention may be formed of virtually any material that is resistant to the liquid chemical that is contained within tank 20. It is presently preferred that the support shells 14, 16 and tank 20 each be formed of a plastics material (e.g., polyethylene) for purposes of weight reduction. However, these components could likewise be formed of chemically resistant stainless steel, if desired.

Furthermore, although a hand pump has been depicted in the accompanying drawing and described above, the unit of this invention could also be provided with a motor-activated pump, if desired.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A portable, self-contained liquid chemical storage and transfer unit comprising:

(i) a support shell having upper and lower support shell sections concentrically joined to one another, said upper support shell having a diametrically opposed pair of upright support arms so as to define therebetween a generally U-shaped space;

(ii) a liquid chemical storage tank contained within said lower support shell section; and (iii) a transfer system positioned in said U-shaped space, said transfer system including;

(a) a metering canister fluid-connected to said liquid chemical storage tank; and (b) a pump fluid-connected to said metering canister; wherein (c) operation of said pump creates a vacuum within said metering canister to draw liquid chemical from said storage tank and into said metering canister.

2. The unit as in claim 1, wherein said upper and lower support shells are molded from a plastics material, and wherein said support arms are formed as a one-piece structure with said upper support shell.

3. The unit as in claim 1, wherein said upper shell section includes at least one handle spanning said upright support arms at an upper end thereof.

4. The unit as in claim 1, wherein said upper support shell section has a lower rim, and wherein said lower support shell section has an upper rim, and wherein said lower and upper rims are sleeved over one another so as to concentrically join said upper and lower support shell sections.

5. The unit as in claim 4, further comprising a strap surrounding said lower and upper rims to positionally join said upper and lower support shell sections.

6. The unit as in claim 1, wherein said lower support shell section includes an annular bottom foot, a sump support, and a frustro-conically shaped bottom wall section joining said annular bottom foot and said sump support.

7. The unit as in claim 6, wherein said liquid chemical storage tank includes a lower wall having a sump cup received within said sump support of said lower support shell.

8. The unit as in claim 7, wherein said liquid chemical storage tank includes a lower wall section having a frustro-conical shape conforming to said bottom wall section of said lower support shell.

9. The unit as in claim 7, wherein said transfer system includes an intake conduit having a terminal end positioned within said sump cup of said liquid chemical storage tank.

10. The unit as in claim 1, wherein said pump of said transfer system is a manually-actuated hand pump.

11. The unit as in claim 1, wherein said transfer system includes a selector valve to selectively allow liquid chemical to be drawn into and discharged from said metering canister.

12. The unit as in claim 11, wherein said transfer system includes a control valve to selectively permit and prevent liquid chemical to be drawn into said metering canister.

13. The unit as in claim 12, wherein said metering canister includes an access opening, and wherein said transfer system includes:

a T-connector coupled to said access opening of said metering canister;

a discharge conduit coupled to one side of said T-connector to allow liquid chemical in said metering canister to be discharged therefrom to an external site; and said control valve being operatively coupled to another side of said T-connector.

14. The unit as in claim 13, wherein said discharge conduit includes a discharge valve.

15. The unit as in claim 1, wherein said pump is a manually-actuated hand pump having one end fluid-connected to said canister and another end fluid-connected to said liquid storage tank, wherein operation of said hand pump evacuates air from said metering canister to allow liquid chemical to be drawn thereinto from said liquid chemical storage tank, which evacuated air is directed into said liquid storage tank to thereby prevent escape of chemical vapors.

16. The unit as in claim 1, wherein said upper support shell includes a bridge support member spanning said pair of upright support arms at an upper end thereof for dependently supporting said metering canister therefrom.

17. The unit as in claim 16, further comprising a support bracket which connects said metering canister to said bridge support member.

* * * * *